US006779582B2

(12) United States Patent
Heissenberg

(10) Patent No.: US 6,779,582 B2
(45) Date of Patent: Aug. 24, 2004

(54) UNIVERSAL HURRICANE SHUTTERS AND METHOD OF FITTING

(76) Inventor: Michael Paul Heissenberg, 725 NE. Bayberry La., Jensen Be, FL (US) 33408

( * ) Notice: Subject to any disclaimer, the term of this patent is extended or adjusted under 35 U.S.C. 154(b) by 2 days.

(21) Appl. No.: 10/155,387

(22) Filed: May 24, 2002

(65) Prior Publication Data

US 2003/0217819 A1 Nov. 27, 2003

(51) Int. Cl.[7] ..... E05D 15/26
(52) U.S. Cl. ..... 160/183
(58) Field of Search ..... 160/183, 199, 160/206, 235, 113, 118

(56) References Cited

U.S. PATENT DOCUMENTS 5,097,883 A * 3/1992 Robinson et al.
5,477,903 A 12/1995 Figueiredo et al.
5,601,130 A 2/1997 Werner et al.
5,957,185 A 9/1999 Robinson et al.
6,122,868 A * 9/2000 Knezevich

* cited by examiner

*Primary Examiner*—Blair M. Johnson
(74) *Attorney, Agent, or Firm*—McHale & Slavin, P.A.

(57) ABSTRACT

A hurricane shutter system with accordion folding shutter assemblies is based on the mathematical relationship between the deployed length of the shutter, the stacked or folded length of the shutter and the size of an opening in a structure. The relationship results in a shutter system that will fit different sized openings with the least number of shutter assemblies and without excess assemblies.

8 Claims, 2 Drawing Sheets

UNIVERSAL HURRICANE SHUTTERS AND METHOD OF FITTING

FIELD OF THE INVENTION

This invention relates to the field of hurricane shutters which form a temporary barrier across openings in buildings or other structures to prevent damage to the interior of the structures by wind, debris and water. Specifically, the invention is directed toward permanently mounted folding or accordion shutters which have a stacked position which clears an opening and a deployed position which temporarily spans the opening.

BACKGROUND OF THE INVENTION

Since Hurricane Andrew hit south Florida, the state government and the hurricane shutter industry have developed a set of standards and the equipment to meet or exceed those standards. There are different requirements for residential houses, low rise buildings and high rise buildings. There are many shutter systems which comply with these standards, including the shutters of this invention.

The building or construction industry has, long ago, standardized the size of building components, including the sizes of openings, so that standard sized doors and windows may be manufactured economically off site. Because there is need for different sized mass produced windows and doors, the standard sizes differ in multiples of six inches.

Conventionally, accordion folded hurricane shutters are made from extruded aluminum with blade assemblies of set dimensions and angular orientation. A blade assembly usually includes two blades joined with an intermediate longitudinal knuckle joint, and knuckle elements on each longitudinal free edge. To fit a shutter to a window, the number of blade assemblies is determined that will cover the horizontal span of the window. Adjusting the shutters to fit different sized windows merely requires adding or subtracting the number of blade assemblies to be used. However, this practice results in some windows having excess blade assemblies because of the difference in the window size and the blade assembly size.

The major function of hurricane shutters is to provide protection for windows, doors and other openings of a building to prevent failure of the optical covering, such as glass or other transparent materials, or other structurally weak elements. The hurricane shutters are designed to deflect wind, rain and stop wind carried debris from breeching the more fragile devices which close openings in normal weather conditions. The hurricane shutters also have a security function regardless of weather. To this end, several shutter designs incorporate some type of locking devices.

Another important feature of hurricane shutters is the ease and convenience of deploying the shutters on the building or motor home, RV, boat, etc. While weather forecasting and storm tracking are much improved, nobody is really sure of the areas of most potential damage for more than 12 hours. In this time frame, weather conditions in the affected area have deteriorated making the handling of any large heavy objects extremely difficult. For these reasons, and others, the pre-installed shutters are very popular.

Pre-installed or mounted shutters must be unobtrusive, pleasing in appearance, and unrestrictive in normal weather conditions. In normal weather conditions, the shutters are in a stacked or folded position clear of the opening about which they are mounted. In the deployed position, the shutters completely span the opening forming a continuous barrier across the opening. However, the criteria for the stacked position and the deployed position are sometimes at odds, in the view of the consumer. For example, a house with several different window sizes may have one size window with folded accordion shutters forming a narrow border on each side of one window and a much broader border on another window with a minor window size distinction. This variation may be 10 to 15% from window to window. This gives a haphazard look to the shutter installation detracting from the appearance of the house. For example, conventional shutters come in sizes of 5.4 inches or 6.8 inches and for a conventional window of 54 inches, the nearest shutter size may be 58 inches with a surplus of 4 inches. The next size window may have no surplus shutters. This same situation is true in the low rise and high rise shutters.

What is needed in the art is a hurricane shutter system that will result in a uniform appearance to the stacked hurricane shutters on different sized windows.

DESCRIPTION OF THE PRIOR ART

U.S. Pat. No. 5,477,903 to Figueiredo et al is directed to an accordion folded hurricane shutter with particular emphasis on the angular orientation of the blades in the deployed position.

The Werner et al patent, U.S. Pat. No. 5,601,130, relates to an accordion shutter with a center mate for connecting opposite sides of the shutter in the deployed position.

U.S. Pat. No. 5,957,185 to Robinson et al relates to an accordion shutter system with opposing shutter sections fastened together by center mates. Robinson et al teaches that the length or span can readily be altered by using more or fewer shutter members. This conventional approach would result in hurricane shutters with a different number of blades for windows varying as little as one inch. For example, if a window and a shutter system size coincided there would be no excess blades in the stacked position. But if the next window were one inch bigger another set of blades would be required making the stack bigger. This excess of blades would increase as windows got larger until a window size was reached which would again coincide with the number of blades.

Currently all shutter manufacturers have either two or three systems divided into residential, low rise and high rise. For each system, they produce separate blades, center mates, starter strips, and roaming connectors, nylon bushings and several types of tracks. The three different systems would require about 18 different extrusions for each system. This creates a very large inventory of components. Each inventory item is then produced in, at least, four colors which results in an inventory of at least 216 items for one complete inventory.

SUMMARY OF THE INVENTION

Disclosed is a hurricane shutter system with accordion folding shutter assemblies sized on the mathematical relationship between the deployed length of the shutter, the stacked or folded length of the shutter and the size of a conventional opening in a structure. The relationship results in a shutter system that will fit different sized conventional openings with the least number of shutter assemblies and without excess assemblies. The system also results in universal sized components for the residential, low rise and high rise buildings differing only in the strength of the shutters.

Accordingly, it is an objective of the instant invention to teach a hurricane shutter system which will present a uniform stacked appearance with different sized standard window and door openings in residential, low rise and high rise structures. The clear span of the standard sized openings and the clear span of the stacked shutters is approximately the same.

It is a further objective of the instant invention to teach an accordion shutter system with standardized center mate elements for fastening opposite horizontal sections.

It is yet another objective of the instant invention to teach an accordion hurricane shutter system in which there is a size relationship between the stacked size of the blades and other elements and the deployed size of the blades and other elements.

It is a still further objective of the invention to teach the size relationship between the stacked size and the deployed size is related to standard sizes of openings which results in a shutter system sized to fit standard openings without excess blades.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

The shutter system of this invention also consists of three models. Each model may have a different blade to meet design pressures required for the residential system, a low or mid rise system and a high rise system. The blades differ only in the ability to withstand higher pressures of the building design. All other components, such as, center mates, starter strips, roaming connectors, nylon bushings and several types of tracks are completely interchangeable between the three systems. The inventory items for a complete inventory of four colors may be about 72 items.

Figure 1:
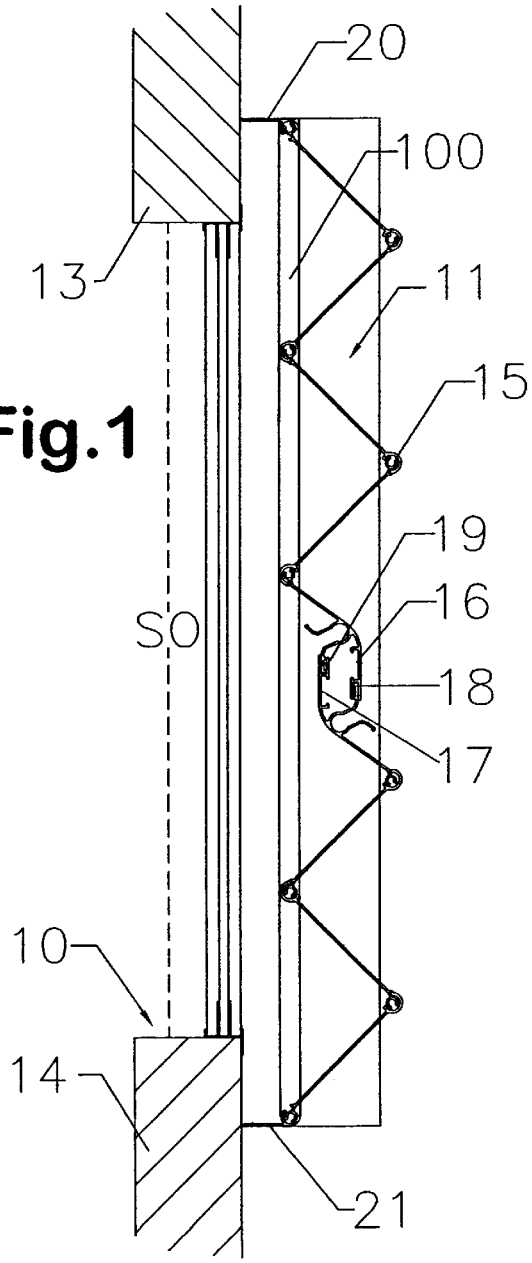
FIG. 1 is a cross section of a deployed shutter system of this invention.
Figure 4:
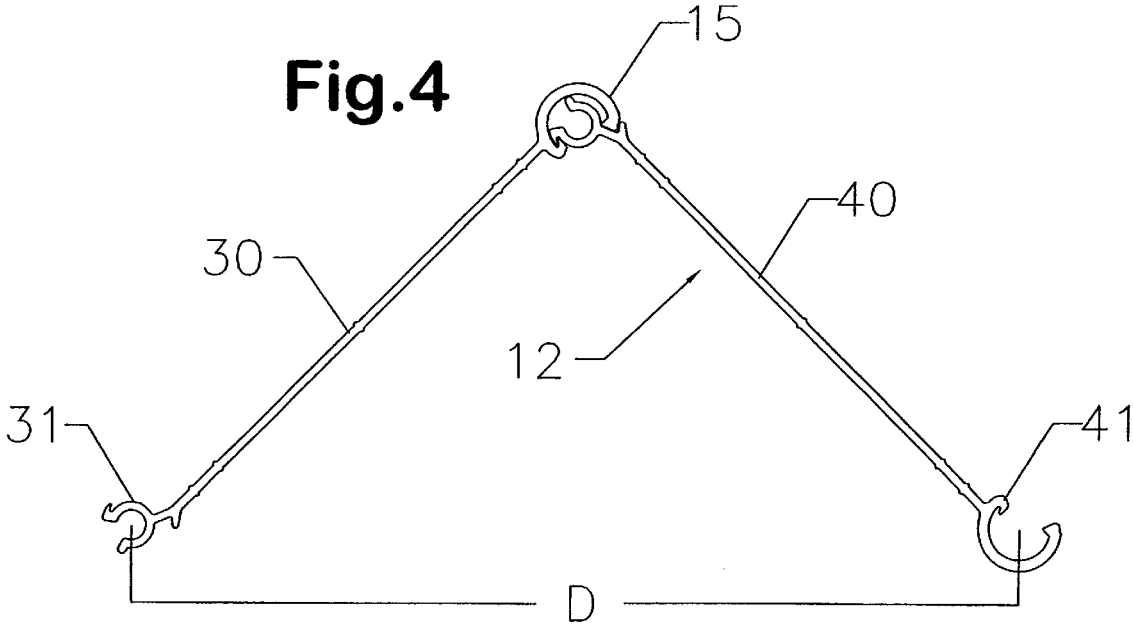
FIG. 4 is a cross section of a blade assembly of this invention.

A deployed hurricane shutter is shown in FIG. 1. The opening 10 may be a window, a door, or other opening in a larger structure. A standard sized opening SO, in the building industry, is normally used to accommodate prefabricated components such as windows and doors. The largest common denominator of the standard sized openings is 6 inches, e.g. 18, 24, 30, 36, 42, 48, 54 inches etc. The shutter system 11 includes track components mounted on the building or structure about the opening for guiding and supporting the hurricane shutter. One track 100 is shown in FIG. 1. The shutter system 11 has a plurality of blade assemblies 12, as shown in FIG. 4. A blade assembly 12 has two panels 30 and 40 connected by a knuckle joint 15 and complimentary joint elements 31 and 41.

In the deployed position, the blade assemblies are extended from the opposing edges 13 and 14 of the opening until the set angular orientation between blades is reached by rotational limit of the knuckle joint 15. The size of each blade with attached knuckle components and the set angle determines the deployed size D of the blade assembly shown in FIG. 1. The deployed size D is used to calculate the number of blade assemblies necessary to cover a particular sized window.

When each opposing blade set 90 is at the extended limit, the center mates 16 and 17 are in contact. Each of the center mates carry a fastener 18 and 19 which cooperate to releasably connect the opposing shutter sets in a continuous barrier spanning the opening 10. The center mates have a deployed dimension and a stacked dimension.

The shutter system 11 also has starter strips 20 and 21 at each edge to provide a fastening to the opposing edges 13 and 14, respectively, of the opening. The starter strips have an anchoring flange and a cooperating portion of a knuckle joint which is rotatably connected to the knuckle portion of the terminal blade assembly. The starter strips may be uniformly mounted at the opening, either adjacent the opening or in the opening. The starter strips may have a deployed dimension and a stacked dimension. Since the starter strips are added to the outer edges of the system, depending on the way they are mounted, they may or may not have a bearing on the overall dimensions of the system. In any event, the installation would be uniform with uniform starter strips.

Figure 2:
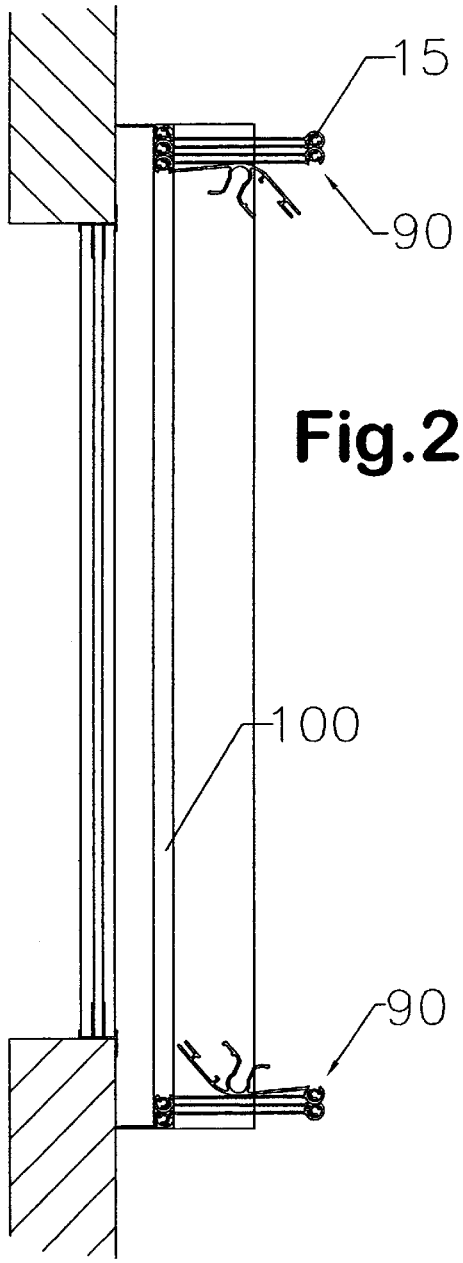
FIG. 2 is a cross section of a stacked shutter system of this invention.
Figure 3:
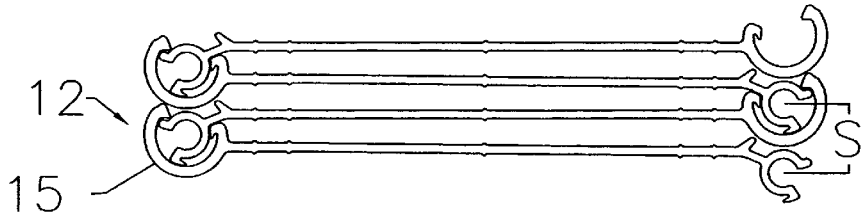
FIG. 3 is a cross section of a stacked shutter of this invention.

When not in use, the hurricane shutter system is folded into the stacked position, shown in FIGS. 2 and 3. Each blade assembly 12 is reduced to a smaller dimension S. An important feature of this system is shown in FIG. 2 which depicts the clear span of the standard opening and the clear span of the stacked shutter as equal. The stacked position of the shutter has its center mates 16 and 17 level with the edge of the opening SO. Regardless of the size of the standard sized opening, the stacked position will co-terminate. This precision results in a 10% to 15% savings in materials.

The hurricane shutter system of this invention is based on the mathematical relationship between the blade span, the stacked dimension and the dimensions of standard sized openings.

For example, the basic formulae are:

$$D-S=6$$

And $$\frac{SO}{6} = \text{number of blades necessary}$$

In the above instance, the blade assembly 12, in the deployed position may equal 6.5 inches D, including two panels 30, 40 joint elements 31, 41 and connected knuckle joint 15. The stacked position of the blade assembly 12 in FIG. 3, may equal 0.5 inches, thus giving a 6 inches total.

Since the standard construction opening will be a multiple of 6 inches, a division of the distance by 6 will result in the least number of blades that will cover the opening without surplus. Therefore, each opening covered by a shutter system of this invention will have a uniform appearance regardless of the size of the opening.

With regard to the other components, such as the center mates, the difference between the stacked position and the deployed position must be 6 or a multiple of 6. To illustrate, a standard opening of 54 inches can be covered by 16 blades, as follows:

EXAMPLE 1

Blades+Self Mating Centers+Starter Strips 17 blades at 6.5" per pair (3.25" each panel)=55.25" and require 4.25" stacking 2 center mates at 6" per set (3" each center)=6" and require 3" stacking
2 starter strips at 0.5" (0.25" each starter)=0.5" and require) 0.5" stacking
55.25"+6"+0.5"=61.75" coverage area
4.25"+3"+0.5"=7.75" stacking area
61.75"−7.75"=54"

This equation holds true for all standard window and door openings.

EXAMPLE 2

Blades+Equal Mating Centers (Male/Female)+ Starter Strips 16 blades at 6.5" per pair (3.25" each panel)=52" and require 4" stacking
2 equal mating centers at 9" per set (4.5" each center)=9" and require 3" stacking
2 starter strips at 0.5" per set (0.25" each starter)=0.5" and require 0.5" stacking
52"+9"+0.5"=61.5" coverage area
4"=3"=0.5"=7.5" stacking area
61.5"−7.5"=54"

This equation holds true for all standard window and door openings.

The mathematical formulae may be used to solve for other shutter sizes. For a non-standard openings the formulae are:

$$\frac{NS(\text{nonstandard opening size})}{\text{Largest integer resulting in whole number}} = k(\text{constant})$$

$$D-S=k$$

$$\frac{NS}{k} = \text{no. of blades}$$

In this illustration, the blades would be fabricated in the size necessary to accomplish the mathematical requirements of the formulas. For example, if the nonstandard opening were 21 inches, then k would be 7. And if the stacked size S is 0.5 inch, the deployed size D would be 7.5 inches. Each panel of the shutter would be 3.75 inches. The stacked position of this shutter would be co-terminus with the opening.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. Universal hurricane shutters adapted to be permanently mounted on structures to cover different sized openings and having a stacked position and a deployed position, said shutters comprising a plural number of elongated blades capable of withstanding the pressure of high winds, adjacent blades movably connected by knuckle joints to form a continuous barrier span in said deployed position, said number of blades of said universal shutters required to fit said openings is determined by the following algorithm, $$\frac{O}{D-S} = B,$$

in which O is the measured size of said opening, D is the measured size of the deployed position and S is the measured size of the stacked position and B is the number of blades wherein the difference between said stacked position width and said deployed position width of said shutters is a distance of approximately six inches whereby said shutters have a uniform appearance in different sized openings.

2. A hurricane shutter system for installing folding barriers for withstanding high wind to different sized openings in a structure, said system comprising a plurality of serially connected blades, said blades movably supported by tracks adapted to be attached to a structure, said blades having a stacked position and a deployed position, said stacked position of said blades being uniform in different sized openings, said deployed position adapted to extend continuously across said different sized openings, said stacked position adapted to clear said different sized openings and approximately co-terminate therewith, said deployed position and said stacked position related in size whereby each of said different sized openings has a stacked position with uniform appearance, said number of blades required for each different sized opening determined by the following algorithm, $$\frac{O}{D-S} = B,$$

in which O is the measured size of said each different opening, D is the measured size of said deployed position, S is the measured size of said stacked position, and B is the number of blades required for each of said different sized opening.

3. A hurricane shutter system of claim 2 wherein said plurality of serially connected blades are arranged in a first and a second opposing sets, each of said sets adapted to be attached to opposite sides of said different sized openings, each of said first and second sets having a first and second center mate connected to a blade in said first and second set respectively, said first and second center mate adapted to be releasably fastened together in said deployed position, said first and second center mates having a stacked position and a deployed position, said stacked position and said deployed position related in size whereby each of said different sized openings has a stacked position with uniform appearance.

4. Universal hurricane shutters adapted to be mounted on structures to cover different sized openings in said structures, said different sized openings having a common denominator, and having a stacked position dimension uncovering said different sized openings and a deployed position dimension spanning said different sized openings, said hurricane shutters comprising a plurality of blade assemblies having two blades pivotally connected by a knuckle joint, said assemblies dimensions sized on the mathematical relationship between the deployed position dimension, the stacked position dimension and the size of said blade assemblies, the difference between said stacked dimension and said deployed dimension of said blade assemblies is approximately the same as said common denominator of the dimensions of said different sized openings.

5. In a hurricane shutter system for use on structures having different sized openings width-wise, each of said openings being sized as a multiple of 6 inches, the shutter system composed of at least two different sized shutters, one sized shutter having a stacked dimension uncovering one different sized opening and a deployed dimension spanning said one different sized opening, said second sized shutter having a stacked dimension uncovering a second different sized opening and a deployed dimension spanning said second different sized opening, said shutter system comprising a plurality of blade assemblies pivotally connected together, each of said blade assemblies having two blades joined along adjacent edges by a knuckle joint, each blade including a partial knuckle joint along the opposite edge, said blade assemblies being approximately 0.5 inch in width in said stacked dimension and 6.5 inches in width in said deployed dimension, whereby said blade assemblies of said system will co-terminate in all openings without surplus blade assemblies resulting in a uniform appearance in said different sized openings.

6. In a hurricane shutter system of claim 5, said system further comprising track components mounted on the structure about said openings, said track components dimensioned to match said openings width-wise, said track components guiding and supporting said blade assemblies in said stacked position and said deployed position.

7. In a hurricane shutter system of claim 6 said system further comprising opposing blade sets, said opposing sets having a stacked dimension and a deployed dimension, said sets each having a center mate, said center mates being fastened together in said deployed position, said center mates having a deployed dimension of approximately 6 inches and a stacked dimension of 3 inches.

8. A method of providing a uniform appearance to hurricane shutters mounted on different sized openings in a building comprising:

(a) measuring the span O of one opening in the building, (b) measuring a different span O of a second opening in the building, (c) providing a plurality of elongated shutter blade assemblies having two adjacent blades rotatably connected by an intermediate knuckle joint and a portion of a knuckle joint along each opposite elongated side, said shutter assemblies having a deployed position D spanning the opening and a stacked position S with said adjacent blades approximately parallel, (d) calculating the number of said shutter blades necessary to span said one opening using the algorithm $$\frac{O}{D-S} = B$$

where O is the measured size of said one opening, D is the measured size o of the deployed position and S is the measured size of the stacked position, (e) calculating the number of said shutter blades necessary to span said second opening using the algorithm $$\frac{O}{D-S} = B$$

where O is the measured size of said second opening, D is the measured size of the deployed position and S is the measured size of the stacked position, (f) linking said shutter assemblies together by rotatably connecting said portions of said knuckle joints together, (g) installing said shutter assemblies in said one and said second openings whereby said one and said second openings are uniform in appearance in said stacked position and said deployed position.

* * * * *